United States Patent [19]

Genova

[11] 4,307,635

[45] Dec. 29, 1981

[54] LOCKING PLIER AND ADAPTER

[76] Inventor: Ralph F. Genova, 19332 Waltham, Detroit, Mich. 48205

[21] Appl. No.: 102,359

[22] Filed: Dec. 11, 1979

[51] Int. Cl.[3] ..... B25B 19/00

[52] U.S. Cl. ..... 81/463; 29/254

[58] Field of Search ..... 81/52.35, 52.3, 463; 29/254, 255; 294/31 R, 104

[56] References Cited

U.S. PATENT DOCUMENTS

| | | | |
|---|---|---|---|
| 3,743,342 | 7/1973 | Kell | 294/116 |
| 3,750,500 | 8/1973 | Peterson | 81/52.35 |
| 3,791,012 | 2/1974 | Jenkin | 81/52.35 |

*Primary Examiner*—James L. Jones, Jr.

[57] ABSTRACT

An adapter for and in combination with a plier-type toggle locking wrench having an elongated handle with a fixed gripping jaw at one end, an opposing gripping jaw pivotally mounted on the handle, a resilient device urging the pivoted jaw away from the fixed jaw and a toggle mechanism for moving the pivoted jaw toward the fixed jaw, the toggle mechanism including a stub lever variably positioned by a coacting screw operator to effect fine adjustment of the jaws with respect to, and for over-center locking thereof on, the work, the screw operator being threaded into the free end of the handle opposite the fixed jaw, the adapter comprising a replacement screw operator having an externally-threaded portion to be received in the handle and a head portion having an internally-threaded passage adapted to receive a threaded stem of an accessory attachment such as a lifting eyebolt or a impact tool device.

1 Claim, 6 Drawing Figures

LOCKING PLIER AND ADAPTER

BRIEF SUMMARY OF THE INVENTION

This invention relates generally to plier-type toggle locking wrenches, and more particularly to an adapter for increasing the utility of such tools.

There are several brands of locking plier-type wrenches on the market, the wrenches taught in Petersen U.S. Pat. No. 2,280,005, Jones U.S. Pat. No. 2,514,130 and Froeschl U.S. Pat. No. 2,966,818 being typical, and they are referred to by various terms such as toggle pliers, grip-lock pliers, etc.

Although the structural details of such wrenches vary somewhat, they all have many common elements such as a handle with a fixed jaw, a movable jaw pivoted to the handle opposite the fixed jaw for clamping a work piece between the jaws, a toggle mechanism arranged and pivotally connected to the handle and to the movable jaw for over-center locking of the jaws on the work piece and a screw operator (18 in Petersen, 13 in Jones and 35 in Froeschl) cooperating with a stub lever portion of the toggle mechanism for adjustment of the jaws to enable such clamping and over-center toggle locking action on work pieces of different dimensions.

Generally, such locking plier tools operate satisfactorily, and at least one such tool is found in almost every toolbox or workshop. However, because these tools securely grip and lock on the work piece, they can be modified to facilitate use thereof for additional purposes, such as lifting devices, impact-type tools and the like. Such modifications have, in fact, been made, as taught by Trusty U.S. Pat. No. 3,253,850 (Quick Releasable Carrying Device) and Jenkin U.S. Pat. No. 3,791,012 (Traction Applying Tool).

Most anyone that knows anything about hand tools will recognize that wrench 10 of Trusty is typical of the above-mentioned locking plier-type wrenches available on the market, and that Trusty has modified the wrench or plier 10 for use as a carrying device by welding the second carrying handle 37 to handle 11 of the pliers.

Similarily, most people will recognize that Jenkin has modified the commercially available plier-type wrench 12 (seemingly the same as wrench 10 of Trusty) by pivotally mounting thereon an impact attachment 31/34 by which a tine work piece 10 gripped by wrench 12 can be pulled from its mounting 11 by impacting the weight 34 movable on rod 31 against the abutment 33.

It will be noted, however, that Trusty clearly did not have Jenkin's impact function in mind, and that Jenkin clearly did not have Trusty's carrying function in mind. Further, it is noted that the modifications of Trusty and Jenkin each require another manufacturing operation—welding in Trusty and drilling for pivotal attachment in Jenkin. Also, at least in Trusty, the modification is permanent and the welded handle 37 must interfere (to varying degrees, depending upon the work situation) with use of the pliers 10 for their originally-intended hand plier purpose. In fact, it seems clear that once the modification of Trusty is made, the result is a quick release carrying device and no longer a plier-type wrench. The same could be true of Jenkin.

Further, it is evident that in order for a purchaser of a locking plier wrench to modify the same to take advantage of the functions taught by Trusty and Jenkin, he must perform welding or drilling operations thereon, which may not be convenient. However, that is not necessary.

It will be noted that the pliers of Trusty and Jenkin also include the adjusting screws 27 and 24, respectively, substantially identical to the pliers of Petersen, etc., referred to above. Recognition and use of this common element (the adjusting screw threaded in the free end of the handle) of all or most prior art grip-lock type pliers makes it possible to provide, as a main object of the invention, a single relatively simple but different means for adapting such prior art pliers to perform at least the functions of both Trusty and Jenkin. Other functions are undoubtedly also possible.

A specific object of the invention is to provide such adapter means that comprises a new replacement adjustment screw operator to replace the adjustment screw provided with the prior art pliers, as such pliers are originally purchased. That is, the screw 24 of Jenkin or screw 27 of Trusty are proposed to be replaced by an adapter screw to be described.

Another object of the invention is to provide such an adapter that comprises a screw having its externally threaded portion adapted to be received by the handle, in manner and for the purpose of the original adjustment screw, but having a head with an internally threaded passage adapted to receive an externally threaded stem of an accessory device or attachment for such pliers.

A still further object of the invention is to provide such a screw adapter having a comparatively enlarged head (as compared to the head of the original screw) so as to provide sufficient material in which to form a plurality of internal threads sufficient to anchor and retain an externally threaded stem.

A further object of the invention is to provide a lift attachment adapter for a locking plier comprising the combination of such an adjusting screw adapter having an external thread at one end adapted to be threaded into the plier handle and an internal thread at the other end with an eyebolt having an externally threaded stem receivable in the internal thread of the adapter, the eye of the eyebolt being adapted to receive a hook or other lifting means.

A still further object of the invention is to provide an impact tool attachment adapter for a locking plier comprising the combination of such an adjusting adapter screw having an external thread at one end adapted to be threaded into the plier handle and an internal thread at the other end with an impact tool attachment comprising a guide rod having an external thread at one end receivable in the internal thread of the adapter and an abutment at the other end and a weight slidably mounted on the rod and adapted to be moved along the rod and impacted against the abutment.

A further object of the invention is to provide a locking plier-type wrench having an adapter adjusting screw with an internal thread in the head thereof, and with other attachment portions cooperating therewith.

These and other objects and advantages of the invention will become more apparent upon reference to the following specification and the appended drawings.

DETAILED DESCRIPTION

Figure 1:
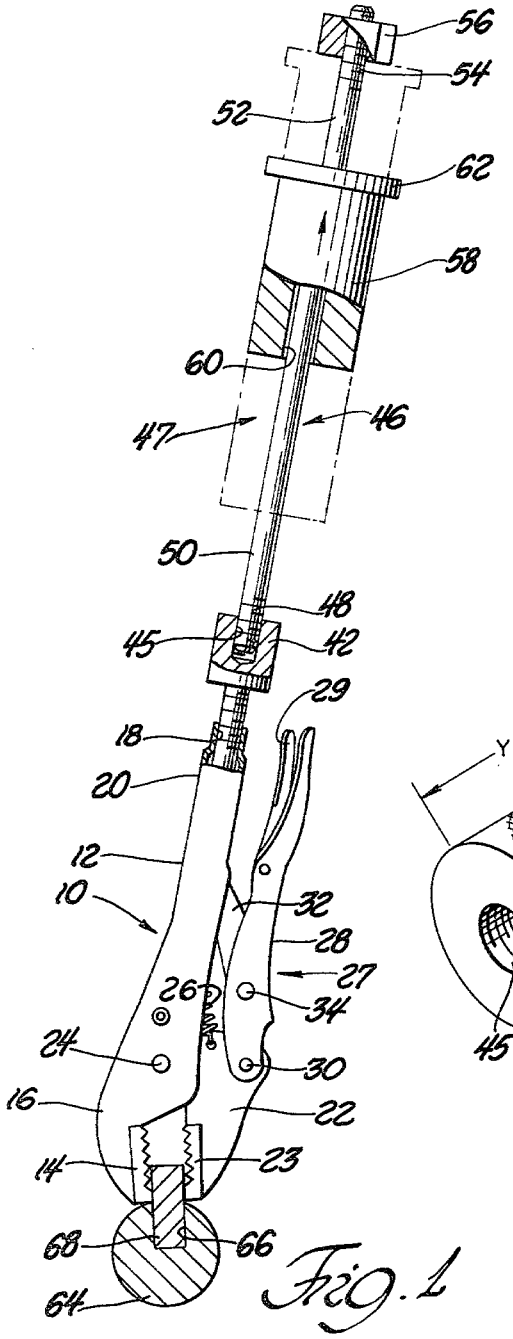
FIG. 1 is a side elevational view, with portions thereof cut away and in cross-section, illustrating a use of a locking plier embodying the invention.

Reference is now made to the drawings, which are for purposes of illustration only, and wherein like elements are identified by the same reference numerals.

Referring specifically to FIG. 1, a locking plier 10, such as that referred to above, comprises a handle 12 having a fixed gripping jaw 14 at end 16 and a threaded passage 18 at end 20. A movable jaw member 22 having gripping jaw 23 is pivotally mounted at 24 to handle end 16, and tension spring 26 secured between jaw member 22 and handle 12 urges jaw 23 away from fixed jaw 14.

A toggle lever system 27 includes a lever 28 pivotally connected at 30 to jaw member 22 and at 34 to a stub lever 32, the end 36 of which engages, or is positioned by, the free end 38 of the adjusting screw 40. In the prior art pliers referred to above, the head 42 of screw 40 is of a length sufficient merely to grasp the same to turn the externally threaded portion 44 in the internal threads 18 and thereby adjust the abutment end 38 within handle 12 and with respect to end 36 of stub lever 32 for the purpose already explained above. That is, such adjustment of screw 40 in the passage 18 of handle 12 merely adjusts the work piece-gripping distance between jaws 14 and 23 at which the toggle lever system moves over center, which enables the jaws to securely clamp and lock onto work pieces of various sizes.

The generally described above structure and operation of pliers 10 is typical and well known in the art, and it is described more fully in the above-mentioned Petersen and other patents. While the specific structure and operation of such prior art lock-grip pliers may vary slightly from one brand of pliers to another, the general structure and operation is much the same. In particular, as stated above, all pliers of this type have an adjusting screw (such as screw 18 of Petersen) in the handle 12. Thus, it is not necessary, for purposes of the invention, to describe such operation in further detail.

Figure 3:
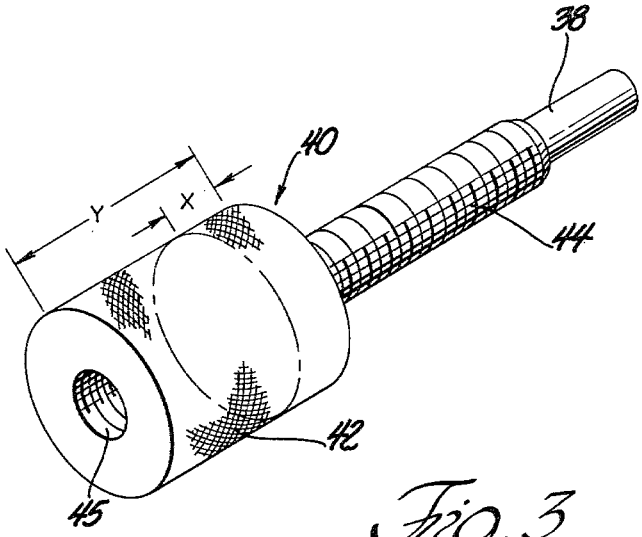
FIG. 3 is an enlarged fragmentary portion of FIG. 1, with portions thereof cut away and in cross-section.

Reference is now made to FIG. 3, which is an enlarged perspective view of the adapter screw 40 embodying the invention. While the externally threaded shank portion 44 and non-threaded end 38 are structurally and functionally generally similar to like portions of prior art adjustment screws, the head portion 42 is modified to specially adapt the same for purposes of the invention. That is, the heads of prior art adjusting screws do not have an internally threaded passage, their function is limited to providing means to grasp the screw to turn the same, and they extend lengthwise only the relatively short distance X of FIGS. 2 and 3, for example.

In contrast, the head of adapter screw 40 embodying the invention comprises a special head 42, the length of which exceeds a length X required to merely grasp the same. The head 42 has a length Y permitting the internally threaded passage 45 to be formed therein, the threads being sufficient in number and diameter to comprise a simple and effective means of anchoring attachments for increasing the utility of locking pliers 10. The threads 45 are preferably of a diameter at least not substantially less than the diameter of external threads 44. Accordingly, the diameter of head 42 may be increased.

In FIG. 1, adapter screw 40 having the internal threads 45 is substituted for the prior art adjustment screw (head length X in FIGS. 2 and 3) not having an internal thread, and an impact attachment 47 is secured to the pliers 10. A guide rod 46 having external threads 48 at end 50 thereof is attached to the pliers 10 by engagement of the external threads 48 with the internal threads 45. The opposite end 52 of rod 46 may be threaded at 54 and fitted with a nut 56 serving as an abutment. A weight 58 is formed with an axial passage 60 receiving the rod 46 so as to be slidable on the rod, as indicated by the broken-line weight positions shown in FIG. 1. The weight 58 may have a flange 62 at one end thereof to prevent injury to the operator's hand in use of the wrench 10 as an impact tool.

FIG. 1 illustrates a motor shaft 64 having a key slot 66 with a key 68 disposed therein tightly so that a tool is required to remove the same. The pliers 10 are adjusted with the adapter screw 40 (in the same manner as with a prior art adjusting screw) so as to clamp and lock the jaws 14 and 23 on the key work piece 68. The weight 58 is then grasped by the operator and moved upwardly so as to be impacted against the abutment 56. In that manner, the weight imparts a force on the key in the direction of the rod abutment 56, to withdraw the key 68 from the slot 66.

Such use of the plier 10 is particularly advantageous when, for example, the shaft 64 is wedged in the key slot or disposed in some difficult to reach location where locking-jaw impact means is convenient or necessary to remove the same. When such a need arises, the impact attachment 47 (rod 50 with abutment 56 and weight 58) may be quickly and easily secured to the pliers 10 by means of the adapter screw 40, for use as described above. When use of the impact attachment 47 is completed, it can be removed, by merely unscrewing the rod 46 from the adapter 40. The wrench 10 is then ready for normal use.

Figure 2:
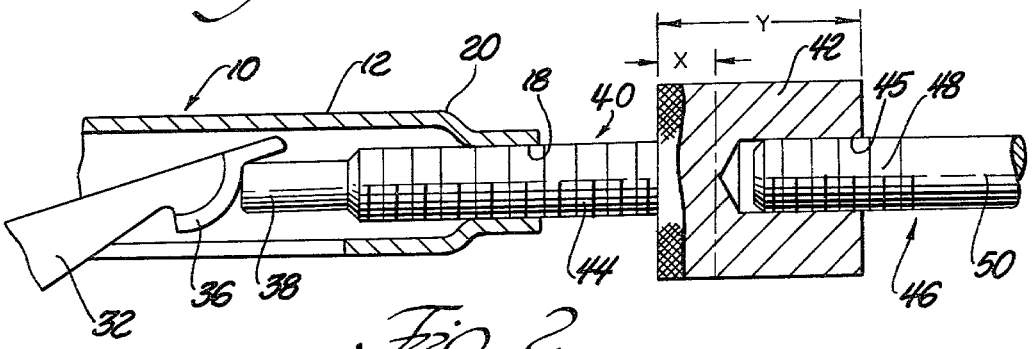
FIG. 2 is an enlarged perspective view of the adapter screw embodying the invention shown in FIG. 1.
Figure 4:
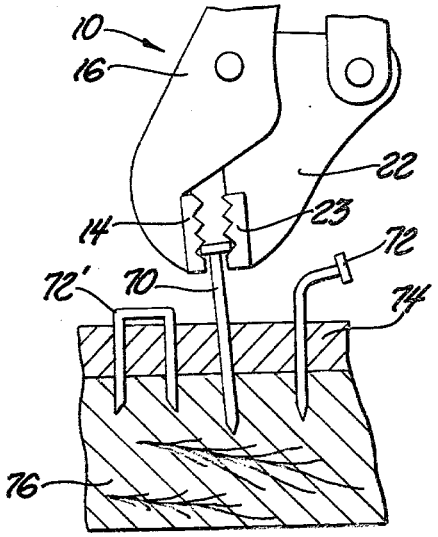
FIG. 4 is a side elevational view similar to FIG. 1, illustrating other uses of the FIG. 1 embodiment of the invention.

FIG. 4 illustrates other contemplated uses of a pliers 10 having an adapter 40 with an impact attachment 47, such as that shown in FIGS. 1–3. Such an impact tool is especially useful when working in cramped spaces where there is room for only one hand or arm to reach the work piece such as a shaft key, a taper pin, a nail or staple, or where there is no room for using a nail pulling tool such as a hammer. Such a tool is also useful for carpenters or cabinet makers, for example, where it is necessary to use care in removing a nail 70, a bent nail 72 or a staple 72′ from wood panels 74 secured to a frame or stud 76 so as to not mar the panel.

Figure 5:
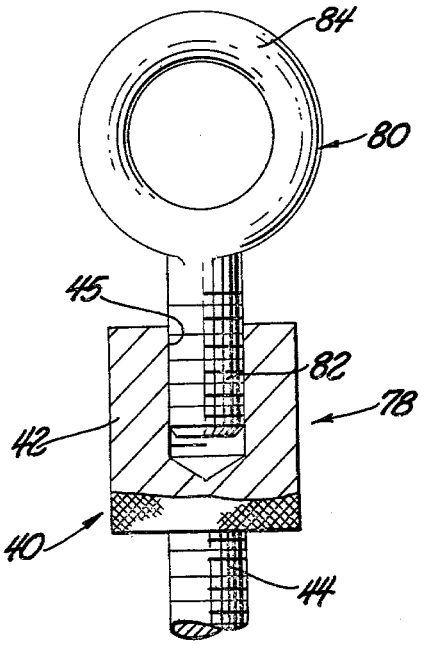
FIG. 5 is an enlarged fragmentary elevational view of a modification of the invention, with portions thereof cut away and in cross-section.
Figure 6:
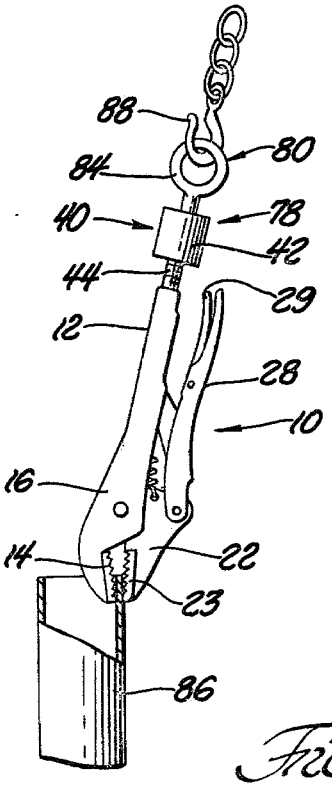
FIG. 6 is a fragmentary side elevational view of the FIG. 5 embodiment of the invention, illustrating use thereof.

FIGS. 5 and 6 illustrate another combination with, and use of, the adapter 40 and plier 10 to provide a lifting attachment 78 for pliers 10. Specifically, the attachment 78 comprises the adapter screw 40 already referred to and described in reference to FIGS. 1–3 and an eyebolt 80 having an externally threaded stem 82 and the eye portion 84.

It is apparent that the internal thread 45 of the adapter 40 and the external thread 82 of the eyebolt 80, like the external thread 48 of guide rod 46, are mating threads.

Eyebolt 80 could be made in various size eye portions 84 and a common size thread 82, in which case the thread 48 of stem 46 and the internal thread 45 would be the same and mating threads, respectively. Such eyebolts are a standard item, except possibly for the thread size.

To provide a pliers 10 including a lifting attachment 78, for example, the original adjusting screw is removed and an adapter screw 40 having a thread 44 is engaged with internal threads 18 of handle 12. The eyebolt 80 is then screwed into the adapter screw head 42, which is longer (length Y) than a prior art adjusting screw (length X) to enable providing a sufficient number of internal threads 45 to support a weight to be lifted.

In FIG. 6, the pliers 10, with lifting attachment 78, including adapter 40 and eyebolt 80, are clamped and locked on the end of a pipe section 86, for example, as the object to be lifted. A chain or rope hook 88 can be engaged with eye portion 84 and the pipe 88 lifted or moved as desired. Any number of objects, otherwise awkward to handle or too heavy to carry for some distance, such as a 4'×8'metal sheet, for example, can be easily and conveniently lifted and/or transported in this manner.

Not only does adapter 40 permit the described multiple uses of pliers 12, but it does so without impairment of the original hand tool locking plier function thereof. For example, Trusty requires and provides the extension 51 for toggle release lever 33, which is lever 29 shown in FIGS. 1 and 6 hereof, but not described herein because it is not critical to the invention. Also, Trusty's handle 37 prevents use of Jenkin's guide rod 31, and it would prevent uses of the adapter 40 contemplated by the invention. Jenkin's rod 31, which appears to be permanently affixed, would also make his pliers awkward, if not impossible, to use for the originally intended purpose. Use of adapter 40 embodying the invention provides other uses for wrench 10, without impairing any uses. It will be understood that other attachments including adapter 40 may be possible.

The adapter 40 could be marketed either alone or as part of a kit including the rod 58 and rod 46 and/or an eyebolt 80, for purchase by owners of prior art locking pliers 10.

It will be apparent that locking pliers 10 fitted with adapter 40, whether originally or subsequently, substantially increases the utility of the pliers, to provide, for example, both the impact tool and lifting functions that would heretofore require use of both Trusty and Jenkin.

While the preferred embodiment of adapter 40 is shown, it will be understood that some attachment means other than internal threads 45 could be employed. For example, some other interlocking means structure might be provided between the adapter screw 40 and the rod 46, eyebolt element 80 or other attachment. However, threads are shown and described because they are a common axial retention means that is effective and relatively simple and inexpensive to provide. That is, the axial retaining force of the screw threads 45 and 82 of lifting attachment 78 is substantial, in relation to the size of pliers 10, and adequate to lift an object such as pipe 86.

The invention has been shown and described in such clear and concise terms as to enable one skilled in the art to practice the same.

While specific preferred embodiments of the invention have been shown and described, it is to be understood that these are representative only, and no limitations are intended, except as recited in the appended claims.

What I claim as my invention is:

1. An adapter kit for adapting a plier-type toggle locking wrench for uses other than its originally-intended use, without in any way impairing the originally-intended use, the wrench having a handle with a fixed jaw at one end and a threaded passage at the other end, a movable jaw pivoted on the handle between the ends of the handle, spring means connected between the handle and the movable jaw for over-center locking of the jaws on a work piece and an adjustment screw threaded in the threaded passage in the handle and having the sole function of adjusting the over-center position of the toggle means, the adjustment screw having a head to be grasped for turning the screw and a threaded portion engaging the threads of the threaded passage and an unthreaded end for engaging the toggle means, said kit comprising an adjustment/adapter screw substitute for the toggle adjusting screw of the wrench, said adjustment/adapter screw substitute comprising a screw also having a threaded portion for engaging the threads of the threaded passage and an unthreaded end for engaging the toggle mechanism, but said adjustment/adapter screw having a head relatively enlarged in length and diameter, as compared to the length and diameter of the head of the original adjustment screw, said enlarged head having an internally-threaded passage formed therein adapted to receive an externally-threaded member, said kit further comprising an impact tool attachment including a cylindrical guide with an impact weight slidably mounted thereon and an eyebolt having a stem, said guide and said stem each having external threads at the free end thereof adapted to engage said internal threads in said enlarged head, whereby the wrench is converted to an impact tool by use of said attachment or to a lifting tool by use of said eyebolt.

* * * * *